US006550093B1

(12) United States Patent
Shioda

(10) Patent No.: US 6,550,093 B1
(45) **Date of Patent: *Apr. 22, 2003**

(54) GOLF BALL CLEANING DEVICE

(76) Inventor: Yoshihiko Shioda, 4603 South Blvd., Charlotte, NC (US) 28209

( * ) Notice: Subject to any disclaimer, the term of this patent is extended or adjusted under 35 U.S.C. 154(b) by 104 days.

This patent is subject to a terminal disclaimer.

(21) Appl. No.: 09/666,237

(22) Filed: Sep. 21, 2000

Related U.S. Application Data

(63) Continuation-in-part of application No. 09/243,965, filed on Feb. 3, 1999, now Pat. No. 6,148,464.

(51) Int. Cl.[7] ..... A63B 47/04; A63B 57/00

(52) U.S. Cl. ..... 15/118; 15/210.1; 15/244.1; 15/104.93

(58) Field of Search ..... 15/118, 21.2, 210.1, 15/221, 244.1, 104.92, 104.94, 104.93

(56) References Cited

U.S. PATENT DOCUMENTS

| | | | | |
|---|---|---|---|---|
| 1,710,816 A | | 4/1929 | Evans | |
| 2,608,705 A | | 9/1952 | Duff | |
| 2,624,900 A | | 1/1953 | Smith | |
| 3,006,009 A | | 10/1961 | Hoffecker | |
| 3,378,873 A | | 4/1968 | Strout | |
| 3,453,675 A | | 7/1969 | Barton et al. | |
| 3,462,230 A | | 8/1969 | Beard | |
| 3,583,016 A | | 6/1971 | McConnell | |
| 3,678,576 A | | 7/1972 | Burkholder | |
| 3,750,219 A | | 8/1973 | MacConnell | |
| 3,806,983 A | | 4/1974 | Cunningham et al. | |
| 4,084,287 A | | 4/1978 | Ingram et al. | |
| 4,103,388 A | | 8/1978 | DeVitis | |
| 4,374,445 A | | 2/1983 | Wilson | |
| 4,403,366 A | | 9/1983 | Lucke | |
| 4,411,040 A | | 10/1983 | Sharrow et al. | |
| 4,683,603 A | | 8/1987 | Purlia et al. | |
| 4,974,763 A | | 12/1990 | Widrig | |
| 5,075,918 A | | 12/1991 | Zeltner et al. | |
| 5,641,232 A | | 6/1997 | Frey | |
| 5,813,080 A | * | 9/1998 | Hendren | 15/118 |
| 5,930,920 A | | 8/1999 | Arnold | |
| 6,148,464 A | * | 11/2000 | Shioda | 15/104.93 |
| 6,226,827 B1 | * | 5/2001 | English, Jr. | 15/104.93 |

FOREIGN PATENT DOCUMENTS

| | | |
|---|---|---|
| GB | 404322 | 1/1934 |

* cited by examiner

*Primary Examiner*—Robert J. Warden, Sr.
*Assistant Examiner*—Kaj K. Olsen
(74) *Attorney, Agent, or Firm*—Kennedy Covington Lobdell & Hickman, LLP

(57) ABSTRACT

An inexpensive, portable golf ball cleaning device which provides a readily accessible means for cleaning a golf ball at any time and at any point on the golf course. The golf ball cleaning device includes a ball cleaning pad removably attachable to a golfer at a position which is readily accessible and convenient for wiping or swiping a golf ball on the pad yet does not interfere with the golfer's swing. In the preferred embodiments, a towel or plurality of towels are attached to the device.

33 Claims, 20 Drawing Sheets

GOLF BALL CLEANING DEVICE

The present application is a continuation-in-part of U.S. patent application Ser. No. 09/243,965, filed Feb. 3, 1999, now U.S. Pat. No. 6,148,464.

BACKGROUND OF THE INVENTION

The present invention relates generally to golf ball cleaning devices and, more particularly, to a portable golf ball cleaning device adapted for attachment to a golfer for providing a readily accessible and convenient means for cleaning a golf ball.

In playing golf, a golfer often must clean dirt, grass and other debris that is sticking to a golf ball from the ball so that the ball will be clean and not be affected when stroked by the dirt, grass or other debris. This is particularly significant before putting a ball on a green where irregularities on the ball can cause the ball to deviate from its path toward the hole. At such times, the mechanical ball washer at the tee box is not at hand and golfers must clean the ball manually. Some golfers carry damp towels for this purpose, others carry dry towels and moisten the spot on the ball by licking or spitting or rubbing it in damp grass. Others simply wipe the ball on their pants or shirt.

Therefore, there is a need for an inexpensive, lightweight, portable golf ball wiper which is readily carried by a golfer for wiping golf balls as needed or desired at any point on the course.

SUMMARY OF THE INVENTION

The present invention is directed to an inexpensive, portable golf ball cleaning device which provides a readily accessible means for cleaning a golf ball at any time and at any point on the golf course. The golf ball cleaning device of the present invention is lightweight and designed to be worn by a golfer for allowing the golfer to quickly and easily wipe off a golf ball as needed or desired by the golfer. The golf ball cleaning device includes a ball cleaning pad and a means for removably attaching the device to a golfer at a position which is readily accessible and convenient for wiping a golf ball on the pad yet does not interfere with the golfer's swing.

In the preferred embodiments, the ball cleaning pad is a water absorbent material which, when wetted, holds water and remains damp for an extended period of time, such as by way of example, a sponge material. The water absorbent material is mounted on a lightweight backing preferably constructed of a waterproof material, such as, by way of example, plastic sheet material or thin metal material or any other waterproof material. In the first preferred embodiment, the backing extends downward and extends outwardly and upwardly to form a bottom portion or storage space at the bottom of the backing for preventing excess water, which may drip off the wetted water absorbent sponge material, from dripping onto the golfer. In addition to preventing water from dripping onto the golfer, the storage space also retains a small amount of water therein and in contact with a portion of the water absorbent material extending into the curved portion so that the water absorbent material is kept damp longer by wicking for providing an effective damp surface for wiping the golf ball thereagainst. In a variation of the first preferred embodiment, the backing includes side retaining walls to better define a reservoir for holding water therein than the bottom portion without the side retaining walls and thus helping to keep the water absorbent material damp longer.

In a second preferred embodiment, the side retaining walls of the first preferred embodiment extend upward from the bottom portion to the top of the backing for preventing water from escaping off the sides of the water absorbent material and dripping onto the golfer. The side walls extend outward from the opposite sides of the backing and adjacent to the water absorbent material mounted on the backing. In use, the side walls form a barrier between the water absorbent material and the golfer to prevent water from dripping onto the golfer, in particular, when the golf ball is pressed against the front of the water absorbent material for cleaning the ball. In a third preferred embodiment, the side walls of the second preferred embodiment extend outward and then inward around the front of the water absorbent material to form a partial enclosure around the material and securing it therein. In this embodiment, the water absorbent material is removably positioned within the enclosure for easily removing and replacing the water absorbent material as desired. For example, the golfer may readily remove the water absorbent material in order to dampen it and may then easily reinsert the material into the enclosure for use. In addition, the water absorbent material may be readily removed and replaced with a new water absorbent material when the water absorbent material becomes soiled or is otherwise unsuitable for further use without having to replace the entire golf ball cleaning device.

Preferably, the water absorbent material has a surface exposed outwardly of the backing and extending in one direction sufficiently for swiping a golf ball thereon. With this arrangement, a golf ball can be swiped by drawing it over the surface of the water absorbent material in a generally longitudinal direction to facilitate cleaning. The golf ball can also be rotated on the material as desired. Typically, an exposed extent of one and one half times the diameter of a regulation golf ball provides a sufficient distance for a swiping action.

In the preferred embodiments, the means for attaching the golf ball cleaning device to a golfer is a hook portion extending outwardly and downward from the top end of the backing. The hook portion is adapted to hook onto a belt or waistband of a golfer so that the cleaning device is conveniently carried at the waist of the golfer and ready for use by the golfer. In an alternative preferred embodiment, the means for attaching the cleaning device to a golfer is a hook and loop-type adhesive material, such as by way of example, Velcro®, adhered to the back of the backing. The Velcro® is adapted to stick to the clothing of the golfer and may be placed anywhere on the clothing at a position which is readily accessible for wiping a golf ball. The adhesive material may require that a compatible material first be attached to the golfer's clothing for mating with the adhesive material to attach the cleaning device to the golfer. Preferably, the cleaning device of the alternative embodiment will be positioned near the waist on the pants or shorts of the golfer. In another preferred embodiment, the means for attaching the golf ball cleaning device to a golfer is a spring clamp or clip attached to the back of the backing. The spring clamp is in a normally closed position and securely holds the device in place when clasped on the clothes of a golfer. While a hook, hook and loop type adhesive material and a spring clamp or clip are described herein, it will be understood that the attachment means may be any suitable element, such as, by way of example a pin, for attaching the golf ball cleaning device to a golfer's clothing or other readily accessible location, such as, by way of example, on a golf cart, for wiping a golf ball.

In a fourth preferred embodiment, the golf ball cleaning device of the present invention includes a water absorbent cloth, such as, by way of example, a small towel, extending downward from the backing for wiping or drying the golf ball after it has been wiped on the water absorbent material, or anytime when the golf ball is damp and requires drying. The absorbent cloth of the fourth preferred embodiment is attached to the backing and is substantially the same width as the backing. The cloth may be attached with a hook and loop type fastener, such as, by way of example, Velcro®, or any other suitable means. In the fourth preferred embodiment, means for removably attaching the backing to a golfer is a narrow hook portion which extends outwardly from the top end of the backing and is adapted to hook the device onto a golfer's pocket. Alternatively, means for removably attaching the backing to a golfer is the spring clamp which securely holds the device on a pocket of a golfer's pants.

Another alternative is to have the backing removably attached to the cloth, such as by Velcro®, and have the cloth removably attached, such as by a safety pin, to the garment of the wearer.

In a variation of the fourth preferred embodiment, a plurality of cloths are attached to the backing. One of the cloths is a back cloth to be used for drying of a clean golf ball or of a golf club or of the hand of a golfer, and another cloth is a front cloth, preferably smaller than the back cloth, that can be dampened and used to wipe a ball or a golf club, such as the grip of a golf club, following which the ball or club or grip can be dried on the back cloth. The back cloth also serves to protect the wearer from the damp front cloth. In this modification, the front cloth can be secured to the back cloth and the back cloth removably attached to the backing and also be removably attached to the garment of the golfer.

Therefore, it is an object and feature of the present invention to provide an inexpensive, lightweight, portable golf ball cleaning device which includes means for removably attaching the device to a golfer for providing a readily accessible and convenient device for cleaning a golf ball at any point on the golf course.

It is another object and feature of the present invention to provide a golf ball cleaning device including a water absorbent material which when wetted remains damp for an extended period of time.

It is a further object of the present invention to provide a ball cleaning device including a water absorbent material having an exposed surface that extends sufficiently for swiping a golf ball therealong for cleaning.

It is an additional object and feature of the present invention to provide a golf ball cleaning device including a bottom portion or storage space for preventing water from dripping off the water absorbent material onto the golfer and for retaining water therein to help keep the water absorbent material damp longer.

It is yet another object and feature of the present invention to provide a golf ball cleaning device including side retaining walls for preventing water from dripping off the sides of the water absorbent material onto the golfer.

It is another object and feature of the present invention to provide a golf ball cleaning device including an enclosure for removably retaining the water absorbent material so that the golfer may readily remove and replace the water absorbent material of the cleaning device.

It is a further object and feature of the present invention to provide a golf ball cleaning device including a hook portion which removably attaches the device to a belt or waistband of a golfer.

It is yet another object and feature of the present invention to provide a golf ball cleaning device including a hook and loop adhesive material for removably attaching the device to the garment of a golfer.

It is an additional object and feature of the present invention to provide a golf ball cleaning device including a spring clamp or clip for releasably securing the device to the garment of a golfer.

It is a further object and feature of the present invention to provide a golf ball cleaning device including an absorbent cloth attached to the device for wiping or drying a damp golf ball.

It is yet a further object and feature of the present invention to provide a golf ball cleaning device having a plurality of absorbent cloths, including a front cloth for damp wiping of a golf ball or golf club or golf club grip, and a back cloth for drying of the object that was wiped on the damp front cloth.

It is yet a further object and feature of the present invention to provide a golf ball cleaning device having an absorbent cloth or cloths that are releasably attachable to the garment of a golfer and to which the backing of the device is releasably attached.

Other objects and features will be readily apparent from the accompanying drawings and description.

DESCRIPTION OF THE PREFERRED EMBODIMENTS

Figure 1:
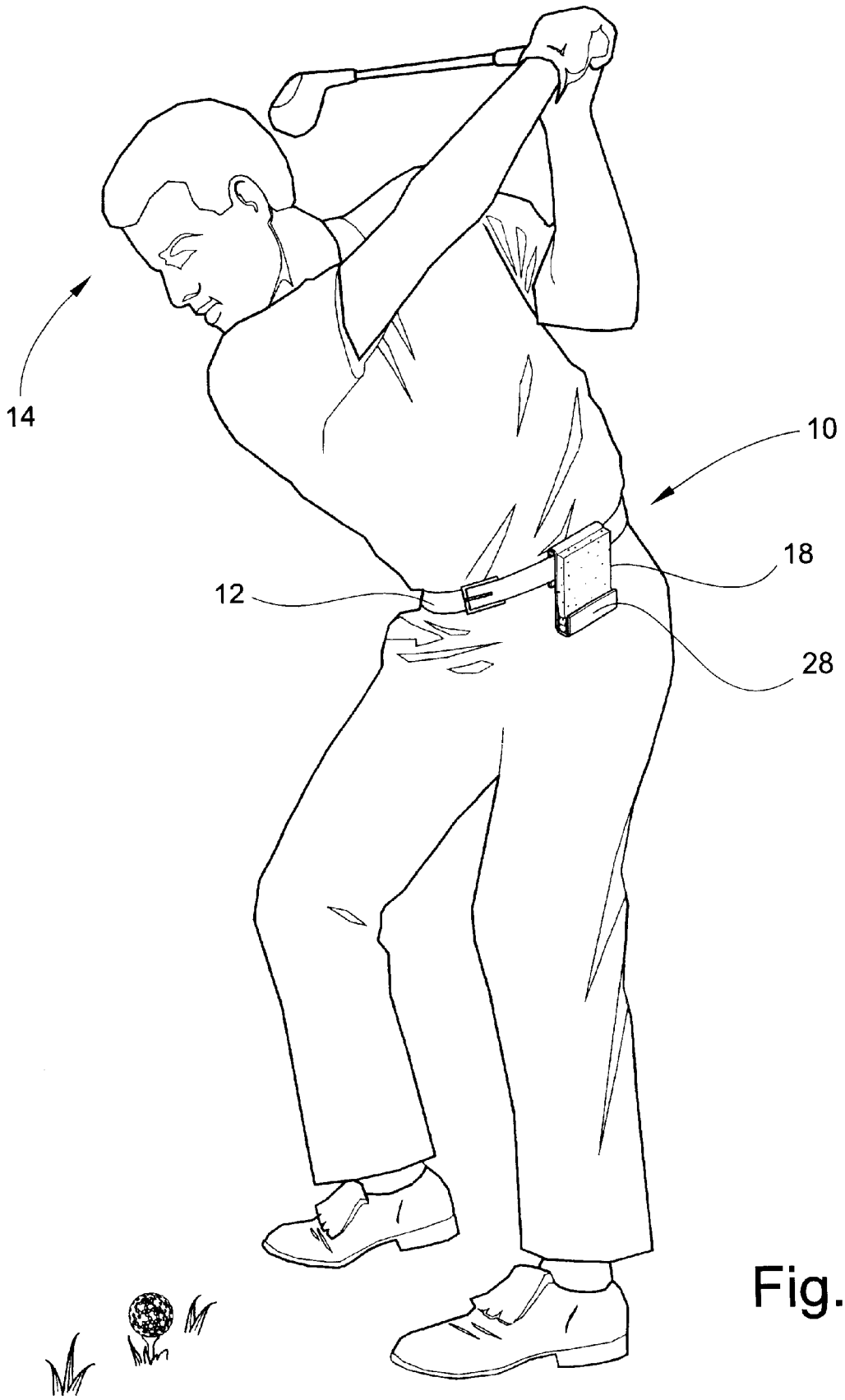
FIG. 1 is a perspective view of the golf ball cleaning device of the first preferred embodiment showing the device attached to the belt of a golfer.

Referring now to the accompanying drawings and. initially to FIG. 1, the golf ball cleaning device of the present invention is designated generally by the reference numeral 10 and is adapted for attachment to a waistband or belt 12 of a golfer 14. The golf ball cleaning device 10 comprises a ball cleaning pad 18 and means for removably attaching the device 10 to a golfer 14 at a readily accessible and convenient position for the golfer to wipe a golf ball as needed or desired by the golfer.

Figure 2:
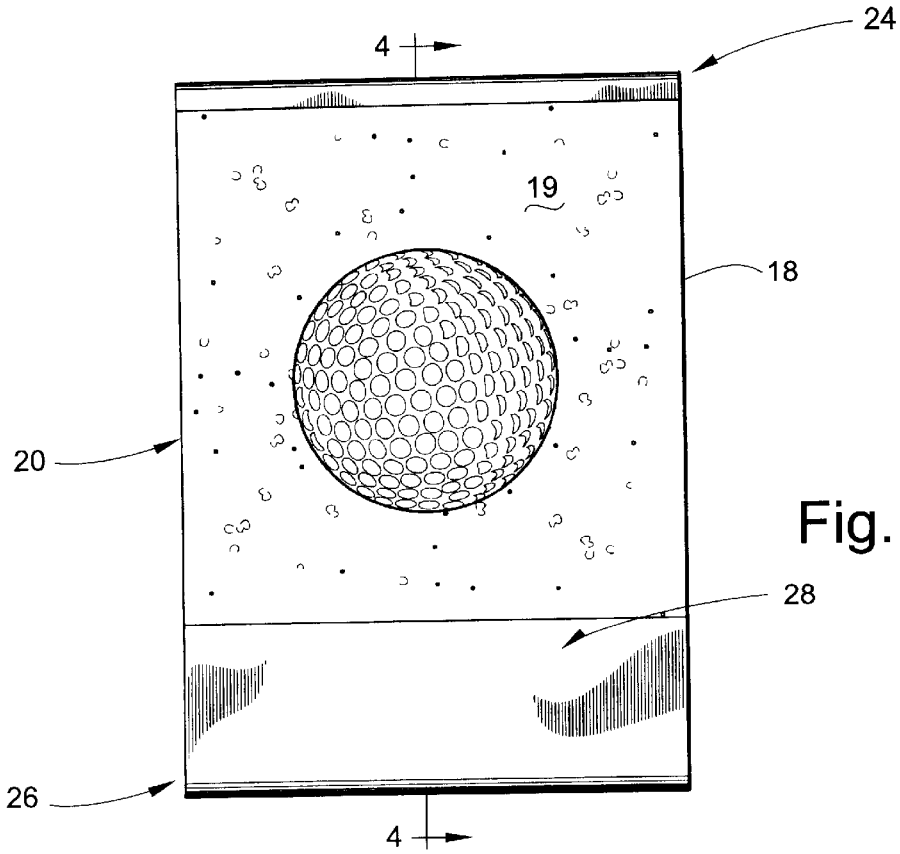
FIG. 2 is a front view of the golf ball cleaning device of FIG. 1 showing a golf ball being wiped or swiped on the sponge material.
Figure 3:
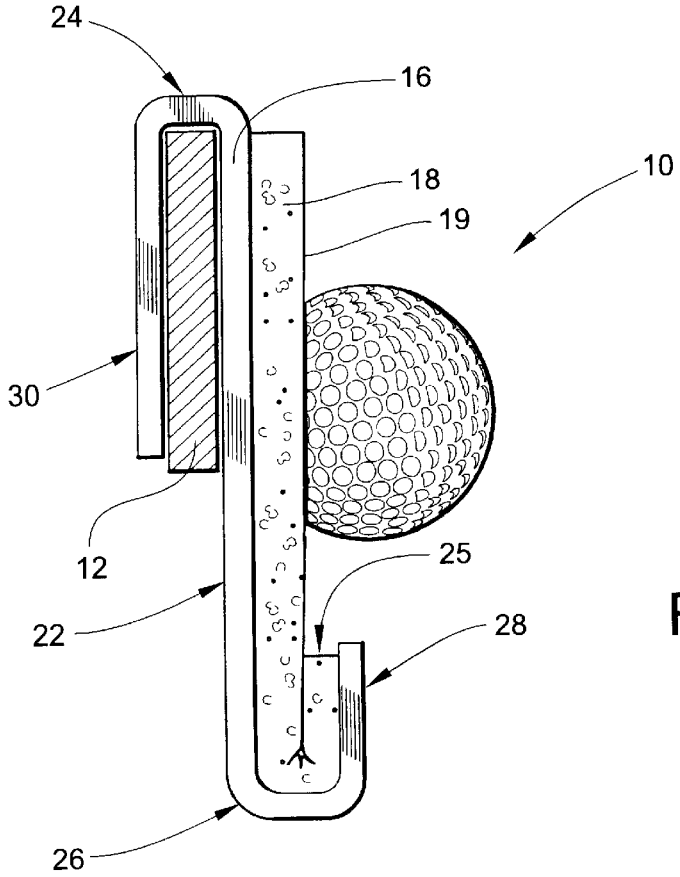
FIG. 3 is a side view of the golf ball cleaning device of FIG. 1 showing the curved portion at the bottom end of the backing and the hook portion at the top end of the backing extending over a belt and showing a golf ball being wiped on the sponge material.
Figure 4:
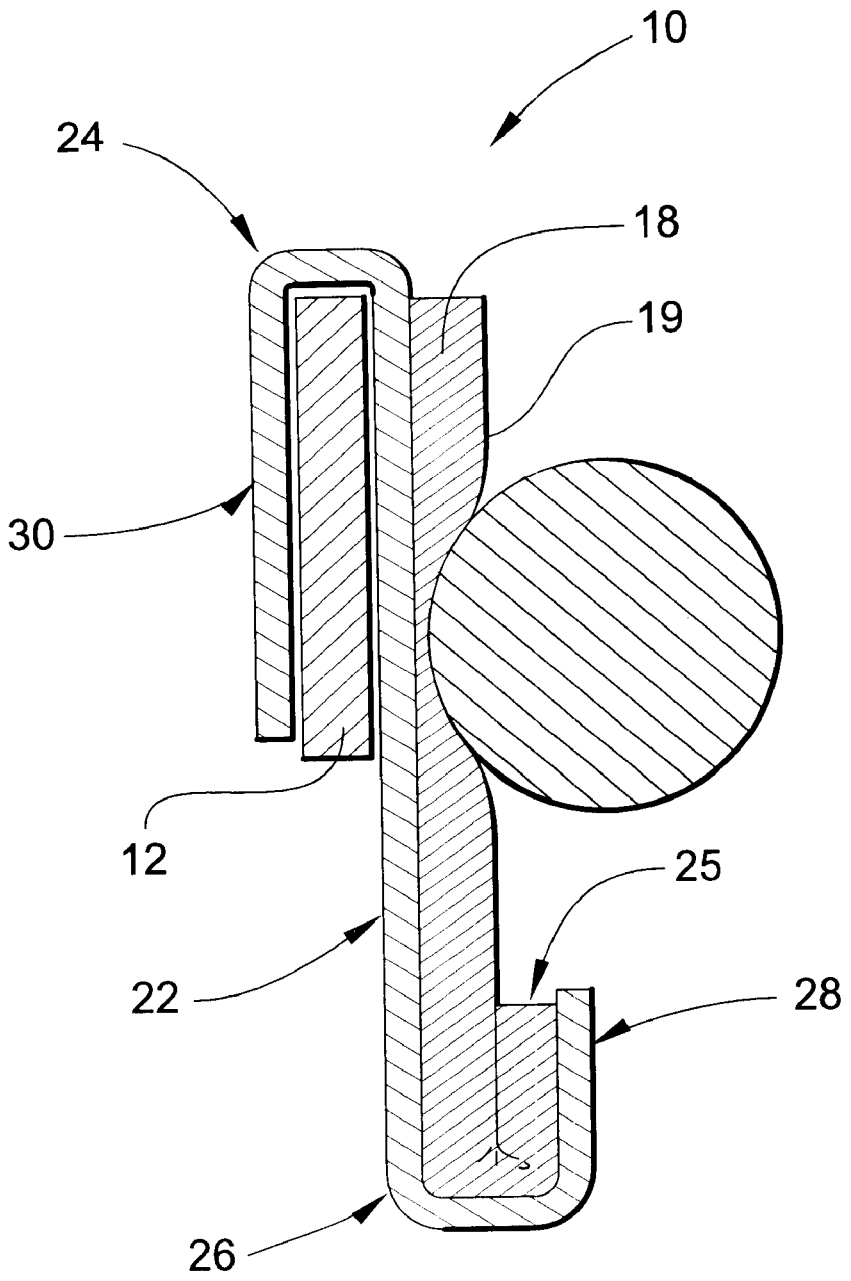
FIG. 4 is a cross-sectional taken along line 4—4 in FIG. 3.
Figure 5:
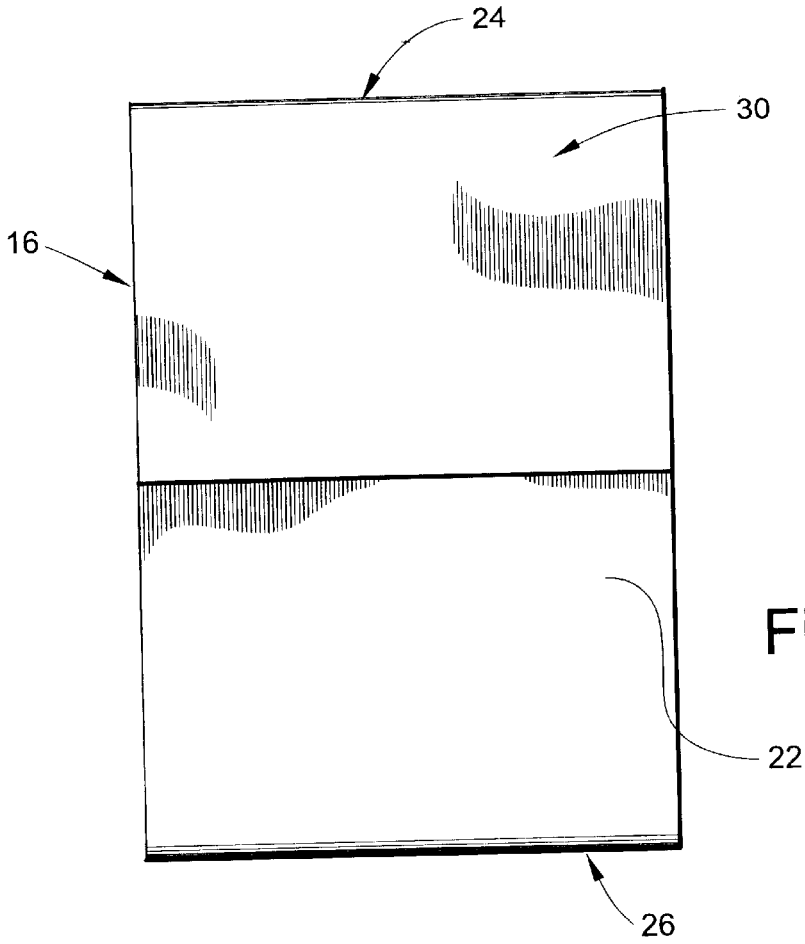
FIG. 5 is a rear view of the golf ball cleaning device of FIG. 1 showing the backing with the hook portion extending across the width of the backing.
Figure 6:
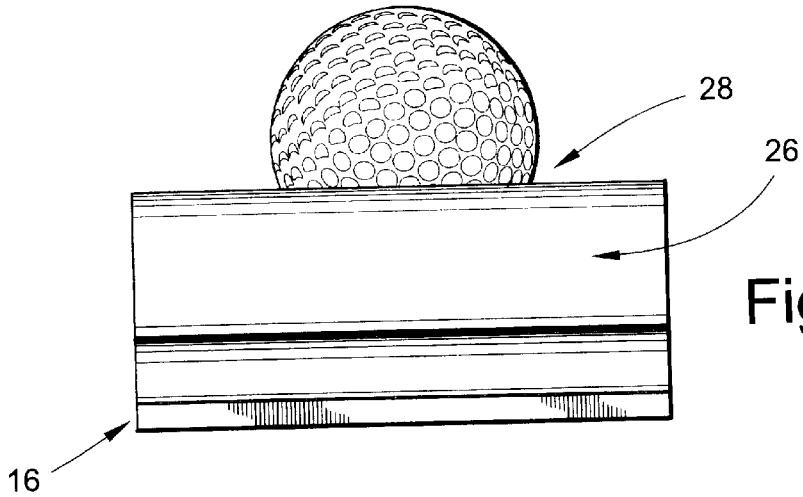
FIG. 6 is a bottom view of the golf ball cleaning device of FIG. 1 showing the bottom of the curved portion.
Figure 7:
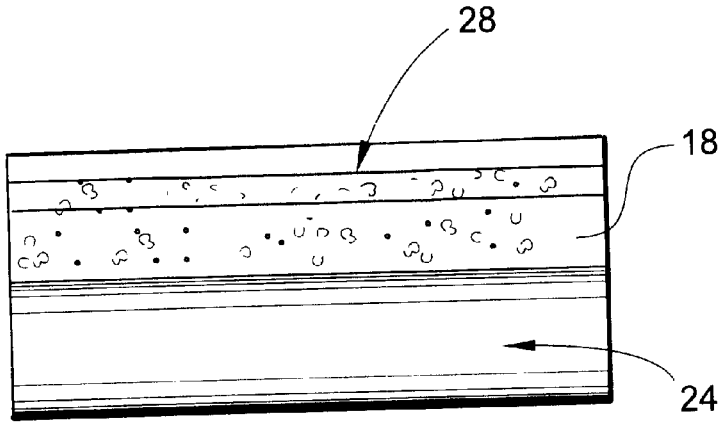
FIG. 7 is a top view of the golf ball cleaning device of FIG. 1 showing the sponge material and a golf ball being wiped or swiped thereon.
Figure 10:
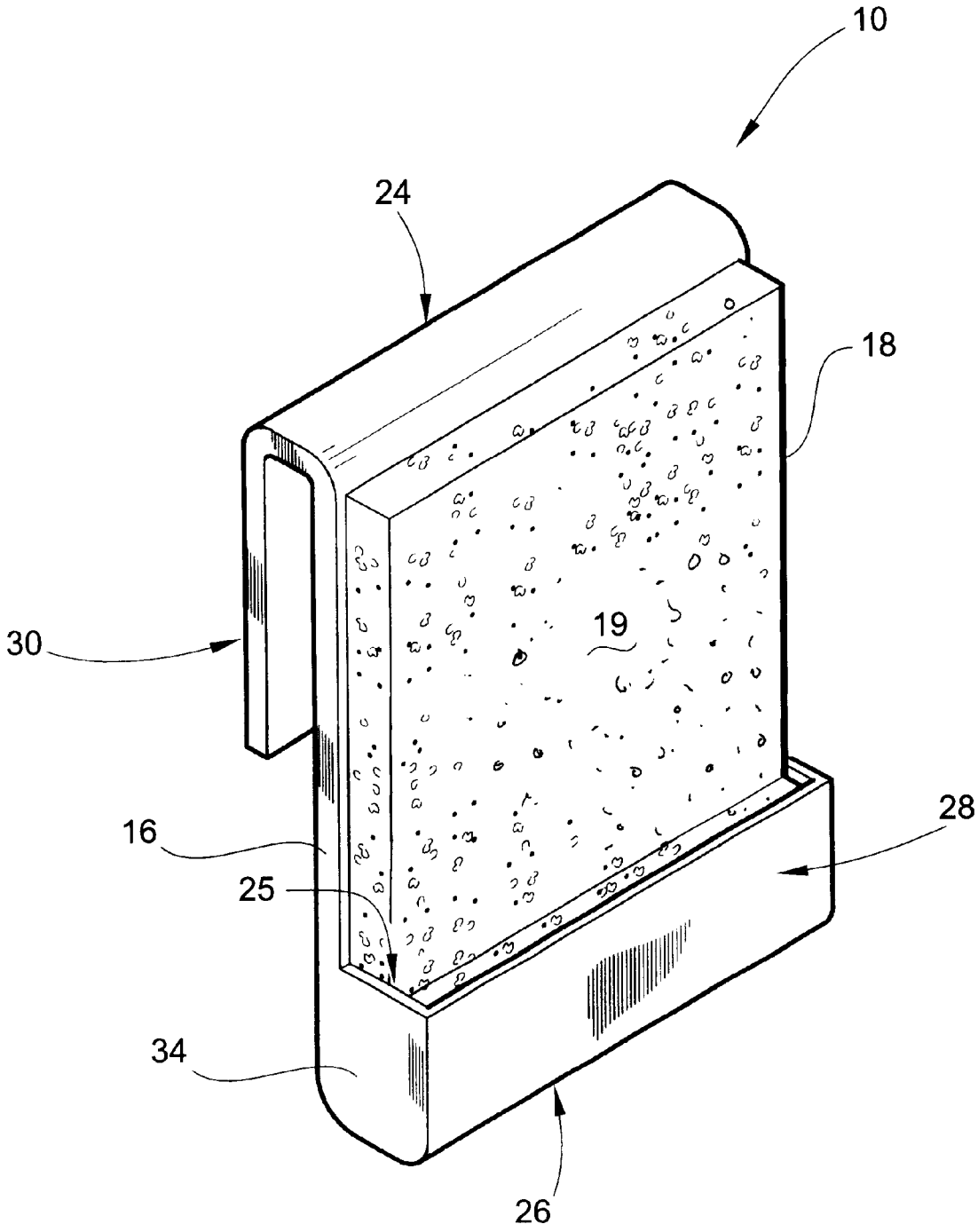
FIG. 10 is a perspective view of a variation of the first preferred embodiment of the device including side walls on opposite ends of the bottom portion.

In the first preferred embodiment illustrated in FIGS. 1–7, the golf ball cleaning device 10 includes a waterproof holder or backing 16 constructed of a plastic sheet material, such as solid polyethylene, or a thin metal material or any other suitable material which is waterproof and lightweight and can support a ball cleaning pad. The backing 16 includes a front side 20, a back side 22, a top end 24 and a bottom end 26. While the pad may be any water absorbent material which, when wetted, holds water and remains damp for at least some period of time, the preferred ball cleaning pad 18 is a sponge material, such as resilient foam plastic, which is retained at the front side 20 of the backing 16. In the preferred embodiment, the sponge material 18 is mounted by any suitable conventional adhesive on the front side 20 of the backing 16 as shown in FIG. 2. As best seen in FIG. 3, the bottom end 26 extends outwardly and upwardly from the front side 20 to form a bottom portion 28 and the sponge material 18 extends into the bottom portion 28. In the preferred embodiment, the bottom portion 28 is curved. As shown in FIGS. 6 and 7, the curved bottom portion 28 extends outward from the front side 20 of the backing beyond the sponge material 18 to define a storage space 25 for the sponge material 18 and excess water. In addition, as shown in FIG. 10, the curved bottom portion 28 may include a pair of side walls 34 for better defining the storage space 25 and providing a reservoir for holding water therein.

In the first embodiment, as well as in all of the other embodiments illustrated and described herein, the cleaning pad 18 of water absorbent sponge material has a surface 19 exposed outwardly of the backing. As illustrated in FIGS. 2, 3, 4, 8, 10, 11, 13, 14, and 17–23, this exposed surface 19 extends in at least one direction a distance sufficient for swiping of a golf ball thereon so that the golf ball can be moved longitudinally along the surface for efficient cleaning of the golf ball. This is in contrast to a small exposed surface that would only allow rotation of a golf ball on the material. Of course, a golf ball can also be rotated on the exposed surface of the material of the present invention. As illustrated in all of the drawings identified above, the extent of the exposed surface in at least one direction is typically at least one and a half times the diameter of a regulation golf ball. According to the current Rules of Golf the diameter of a golf ball shall be not less than 1.680 inches. As can be seen in FIGS. 2–4, 20 and 23, the extent illustrated allows a golf ball to be swiped a considerable distance longitudinally along the exposed surface 19 to facilitate cleaning.

Figure 11:
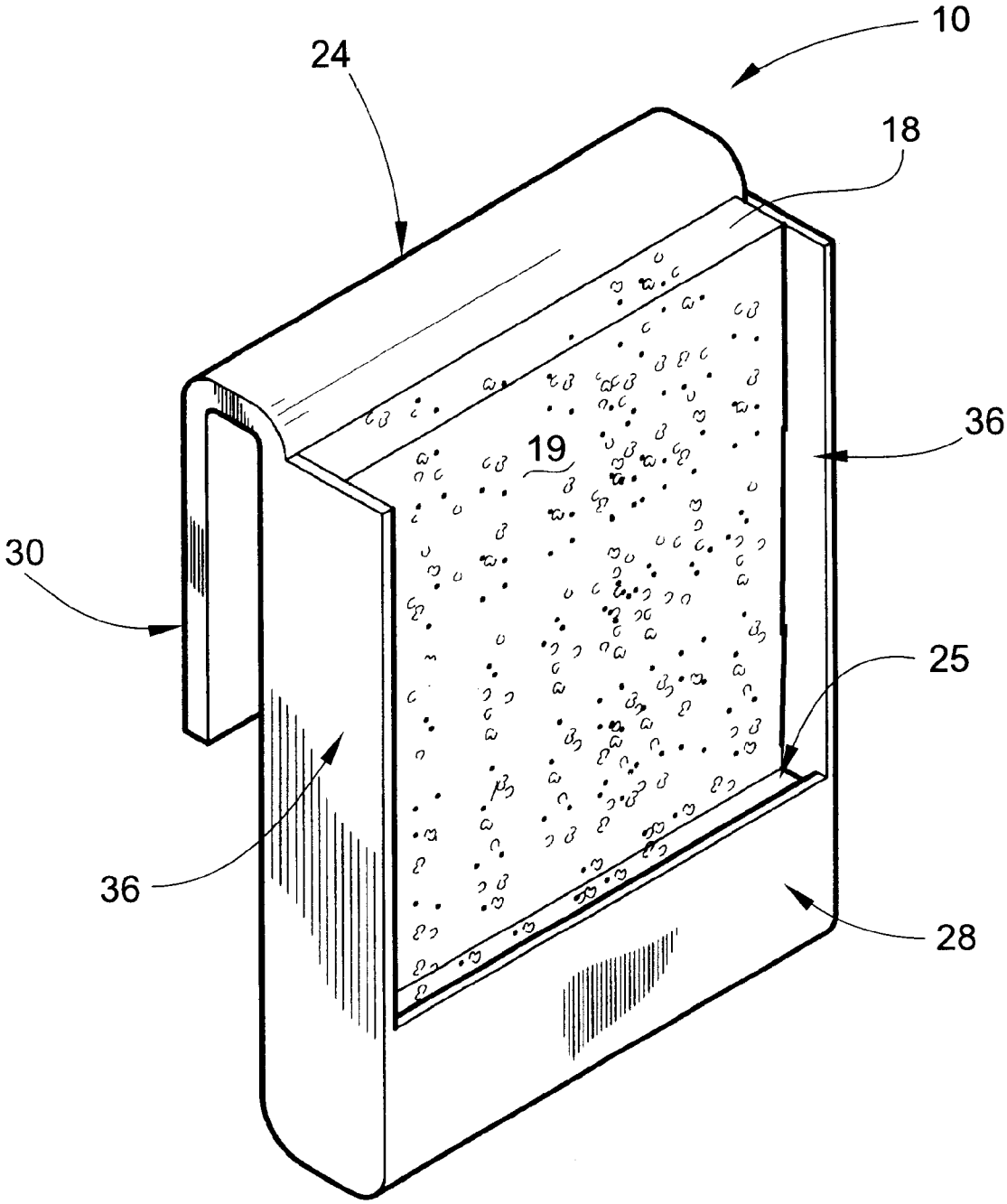
FIG. 11 is a perspective view of a second preferred embodiment of the device including side walls on opposite ends of the bottom portion which extend upward to the top of the backing.

In a second preferred embodiment illustrated in FIG. 11, the golf ball cleaning device 10 of the first preferred embodiment includes a pair of side walls 36 which extend across opposite ends of the curved portion 28 and upward to the top end 24 of the backing 16 for better defining the storage space 25 and providing a barrier between the sponge material 18 and the golfer. In use, the side walls 36 extend outward from opposite ends of the front side 20 of the backing 16 adjacent to the sides of the sponge material 18 to prevent water from dripping onto the golfer, in particular, when the golf ball is pressed against the sponge material 18 for cleaning the ball.

Figure 12:
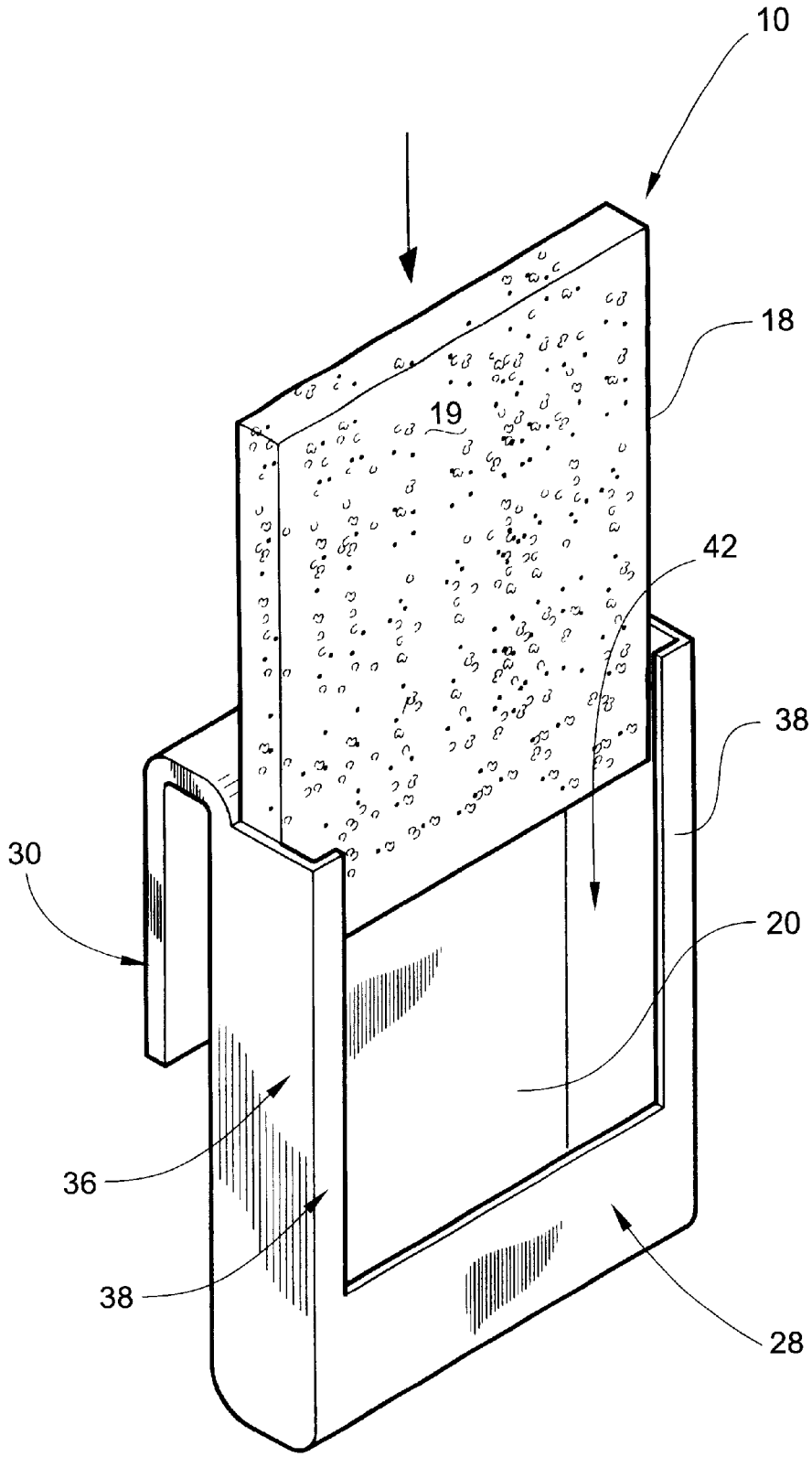
FIG. 12 is a perspective view of a third preferred embodiment of the device including side walls on opposite ends of the bottom portion which extend upward to the top of the backing and inward toward the front of the backing to form a partial enclosure around the water absorbent material which is removably placed therein.

FIG. 12 illustrates a third preferred embodiment of the present invention. In the third preferred embodiment, the golf ball cleaning device of the second preferred embodiment further includes a pair of lips or front walls 38 extending inward from the side walls 36 to form a partial enclosure 42 for retaining the sponge material 18 at the front side 20 of the backing 16. As can be seen in FIG. 12, the front walls 38 extend only partially across the front side 20 of the backing and provide a wide opening 40 so that sponge material 18 held within the enclosure 42 remains readily accessible for wiping the golf ball thereon. As shown in FIG. 12, the sponge material 18 of the third preferred embodiment is retained by the front walls 38 and is not adhered to the front side 20 of the backing 16 so that it may be readily removed from and replaced within the enclosure 42. Thus, the golfer may readily remove the sponge material 18 for dampening it or replacing it, as desired.

The preferred embodiments of the golf ball cleaning device of the present invention include means for removably attaching the backing 16 to a golfer in a position in which the device 10 is readily accessible and conveniently used by the golfer. In the first preferred embodiment, the attachment means is a hook portion 30 which extends outwardly from the back side 22 of the backing 16 and downward from the top end 24. While the hook portion 30 is adopted to hook the device 10 onto a golfer's belt or waistband and is preferably worn by the golfer using the device 10, the hook portion 30 may be secured almost anywhere which includes a location suitable for receiving a hook and is desired by the golfer, such as, by way of example, a golf bag or golf cart. As shown in FIG. 3, the hook portion 30 extends from and is integral with the backing 16 and is preferably constructed of the same thin metal or sturdy plastic material to keep the cost of manufacturing the device low. However, it will be understood that the hook portion 30 may be separate and/or may be constructed of any other suitable material, such as, by way of example, a flexible plastic or rubber material which may be comfortably worn on the golfer's belt or waistband. As shown in FIG. 5, the hook portion 30 extends across the entire width of the backing 16 for securely anchoring the device 10 in place and preventing the device from swinging or tilting from side to side when in use or while the golfer is swinging or walking. As shown in FIGS. 11 and 12, the attachment means of the second and third preferred embodiments of the present invention is also preferably the hook portion 30.

Figure 8:
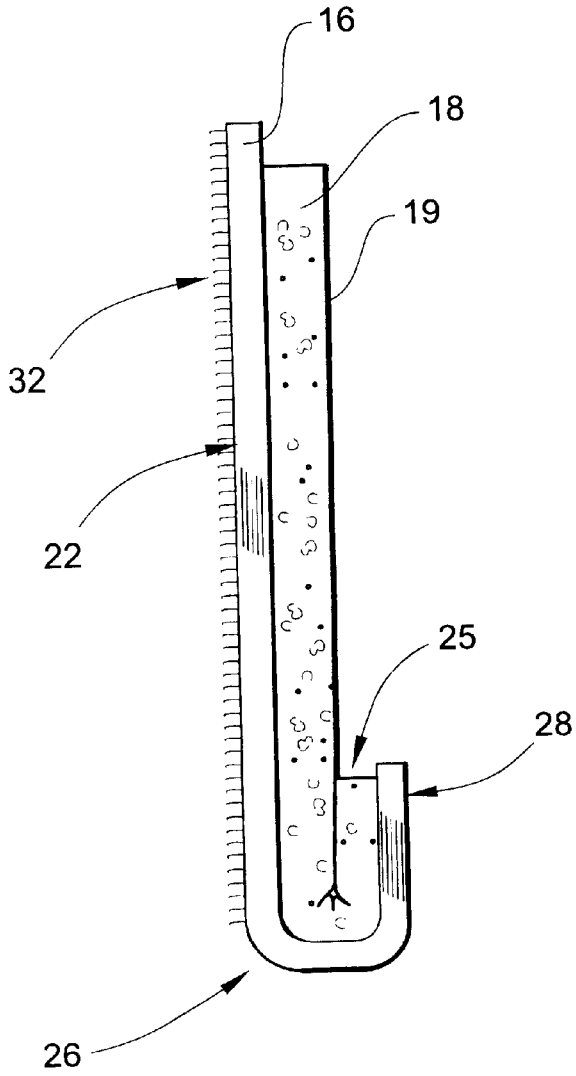
FIG. 8 is a side view of the first preferred embodiment of the golf ball cleaning device showing the curved portion at the bottom end of the backing and an adhesive material on the back of the backing and showing a golf ball being wiped or swiped on the sponge material.
Figure 9:
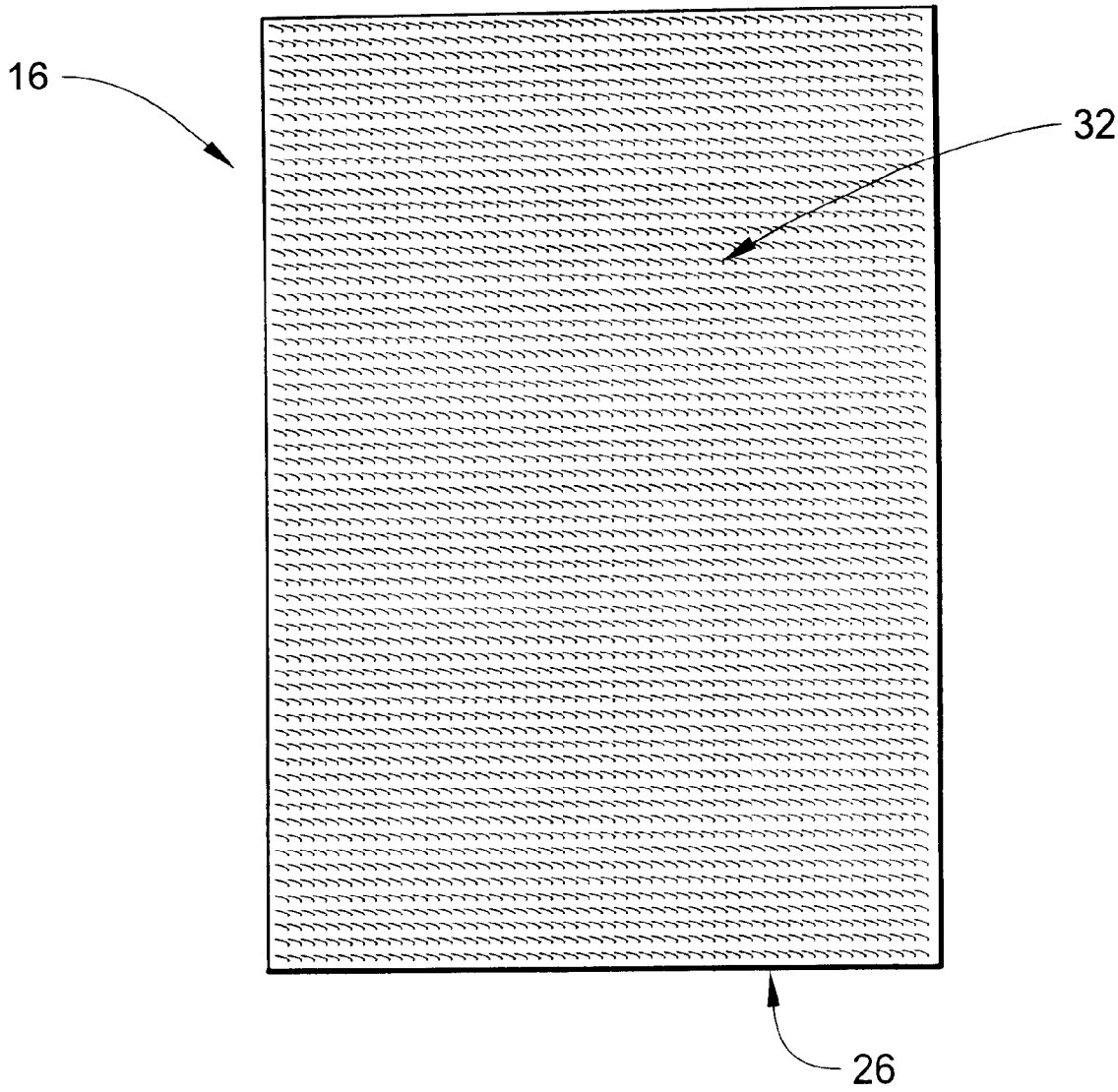
FIG. 9 is a rear view of the golf ball cleaning device of FIG. 8 showing the adhesive material extending along the entire back of the backing.

FIGS. 8 and 9 illustrate an alternative embodiment of the first preferred embodiment of the present invention. In the alternative embodiment, the means for removably attaching the golf ball cleaning device 10 to a golfer is an adhesive material or fastener on the back side 22 of the backing 16. In the alternative first preferred embodiment, the adhesive material is a hook and loop-type fastener 32, such as, by way of example, Velcro®, which is adhered to the backing 16. As shown in FIG. 9, the fastener 32 covers the entire back side 22 of the backing 16 for securely attaching the device 10 to a golfer's clothing or garment. It will be understood that a compatible material, such as a strip including a compatible hook and loop-type fastener, for receiving the hook and loop-type fastener 32 may be adhered to the golfer's clothing for securely attaching the device to the golfer. In addition, the means for removably attaching the golf ball cleaning device to a golfer may alternatively be a pin, such as, by way of example, a safety pin, or any other suitable attachment means.

Figure 13:
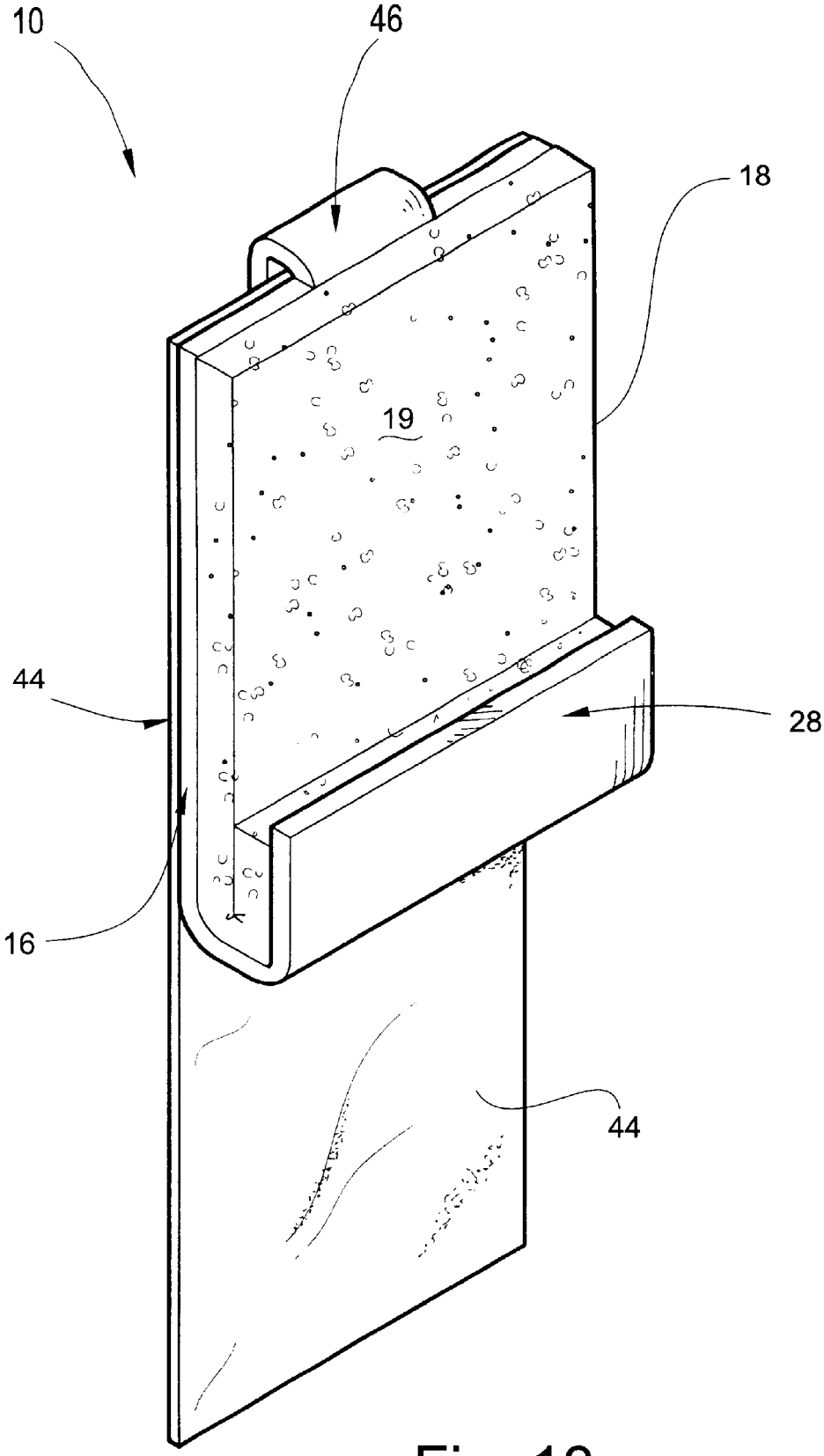
FIG. 13 is a perspective view of a fourth preferred embodiment of the device including a water absorbent cloth attached to the device for wiping a golf ball thereon.
Figure 14:
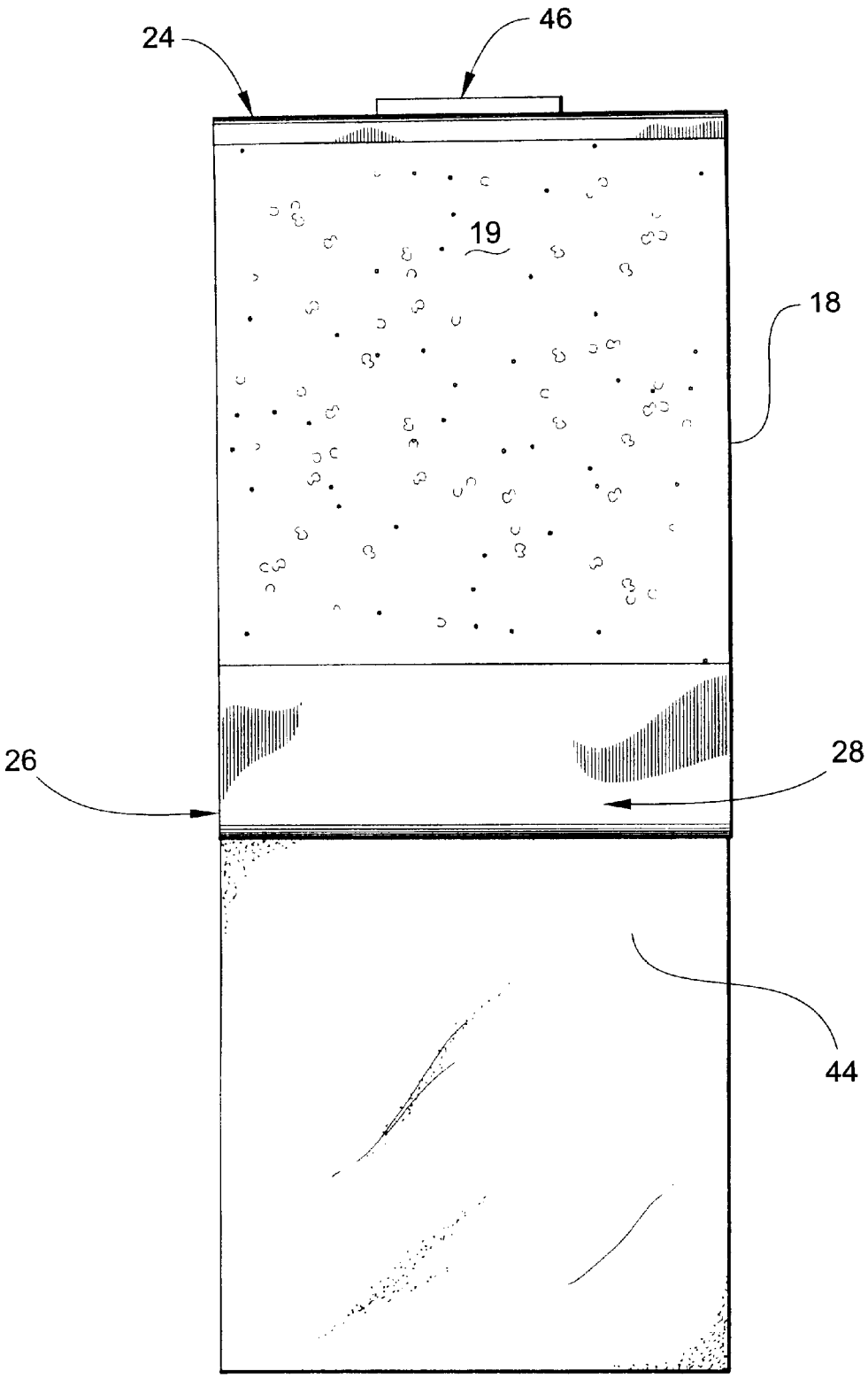
FIG. 14 is a front view of the fourth preferred embodiment of the device shown in FIG. 13.
Figure 15:
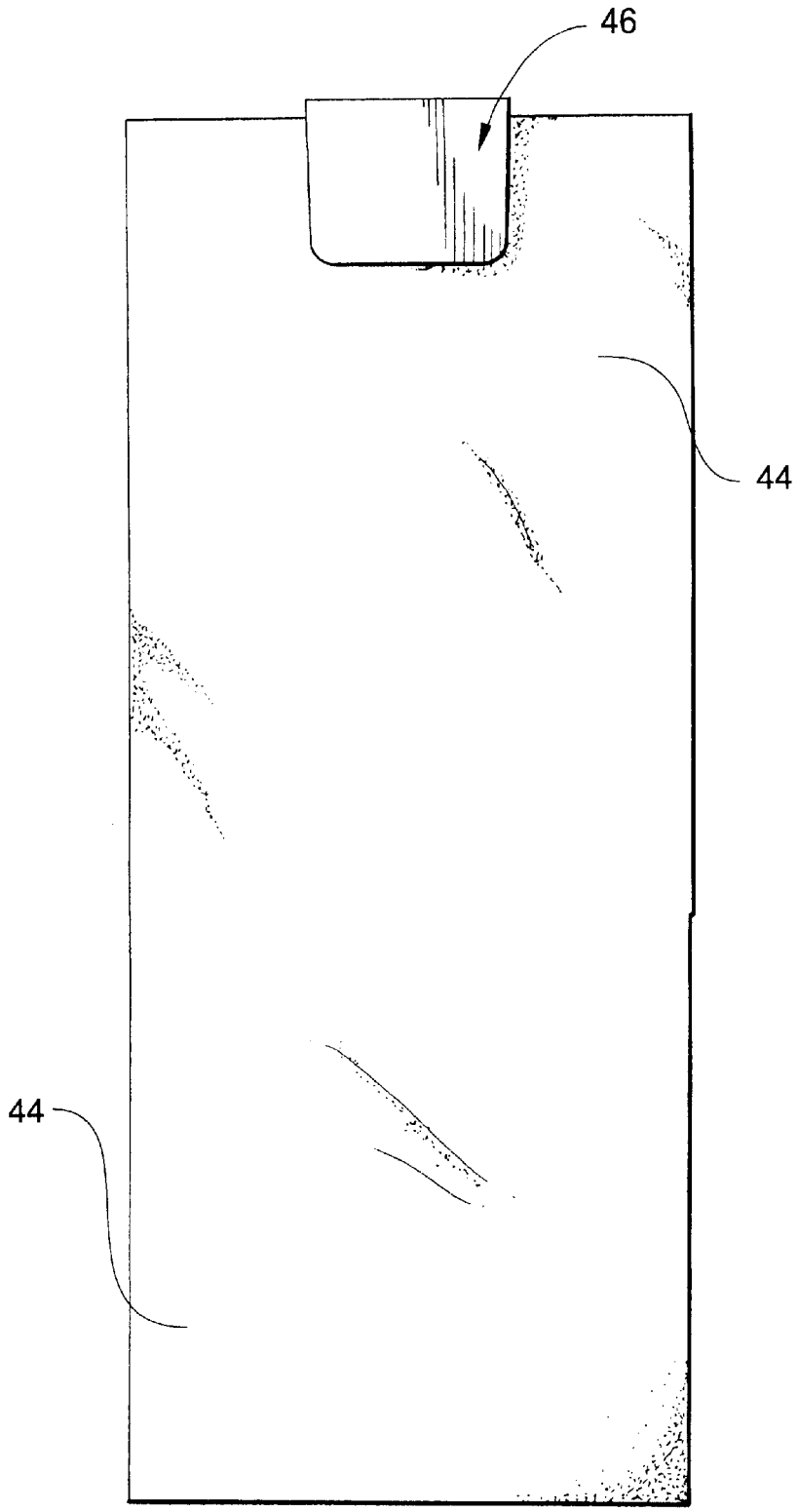
FIG. 15 is a rear view of the device shown in FIG. 14 showing the narrow hook portion for attaching the device to a golfer's pocket.

A fourth preferred embodiment is illustrated in FIGS. 13–15. In this embodiment, the golf ball cleaning device of the present invention includes an absorbent cloth 44, such as, by way of example, a small towel, extending downward from the backing 16 for wiping or drying the golf ball after it has been wiped on the sponge material 18 or anytime when the golf ball requires drying. While the golf ball cleaning device shown includes the features of the first preferred embodiment, it will be understood that the golf ball cleaning device of the fourth preferred embodiment may include the side walls 34 or side walls 36 and/or front walls 38 of the second and third embodiments of the present invention. As shown in FIG. 13, the absorbent cloth 44 is substantially the same width as the backing 16 and extends beyond the bottom end 26 of the backing 16 for a distance which is approximately the same length as the backing 16. The absorbent cloth 44 may be attached to the backing 16 with a hook and loop type fastener, such as, by way of example, Velcro®, where one portion is added to the back side 22 of the backing 16 and a mating portion is added to the absorbent cloth 44. While Velcro® is identified as one suitable method for attaching the absorbent cloth 44 to the backing 16, the absorbent cloth 44 can be attached by any other suitable means and is readily available for use in connection with the use of the golf ball cleaning device 10. In the fourth preferred embodiment, the absorbent cloth 44 extends from the top end 24 of the back side 22 of the backing 16 to the bottom end 26 and for a distance beyond the bottom end 26. Thus, in addition to providing an absorbent surface on which a ball may be wiped, the absorbent cloth 44 provides an additional barrier between the damp sponge material 18 and the golfer for further preventing water from dripping on the golfer during the use of the device.

In the fourth preferred embodiment, means for removably attaching the backing 16 to a golfer in a position in which the device 10 is readily accessible and conveniently used by the golfer is a hook portion 46 which extends outwardly from the back side 22 of the backing 16 and downward from the top end 24. In the fourth preferred embodiment, the hook portion 46 is adapted to hook the device 10 onto a golfer's pocket and is preferably worn by the golfer using the device 10. The hook portion 46 may be secured almost anywhere which includes a location suitable for receiving a hook and is desired by the golfer, such as, by way of example, a golf bag or golf cart. As shown in FIGS. 13 and 15, the hook portion 46 extends from and is integral with the backing 16 and is narrow to slide into and hook onto a golfer's pocket. The hook portion 46 is preferably constructed of the same thin metal or sturdy plastic material to keep the cost of manufacturing the device low. However, it will be understood that the hook portion 46 may be separate and/or may be constructed of any other suitable material, such as, by way of example, a flexible plastic or rubber material which may be comfortably worn on the golfer's pocket, belt or waistband.

Figure 16:
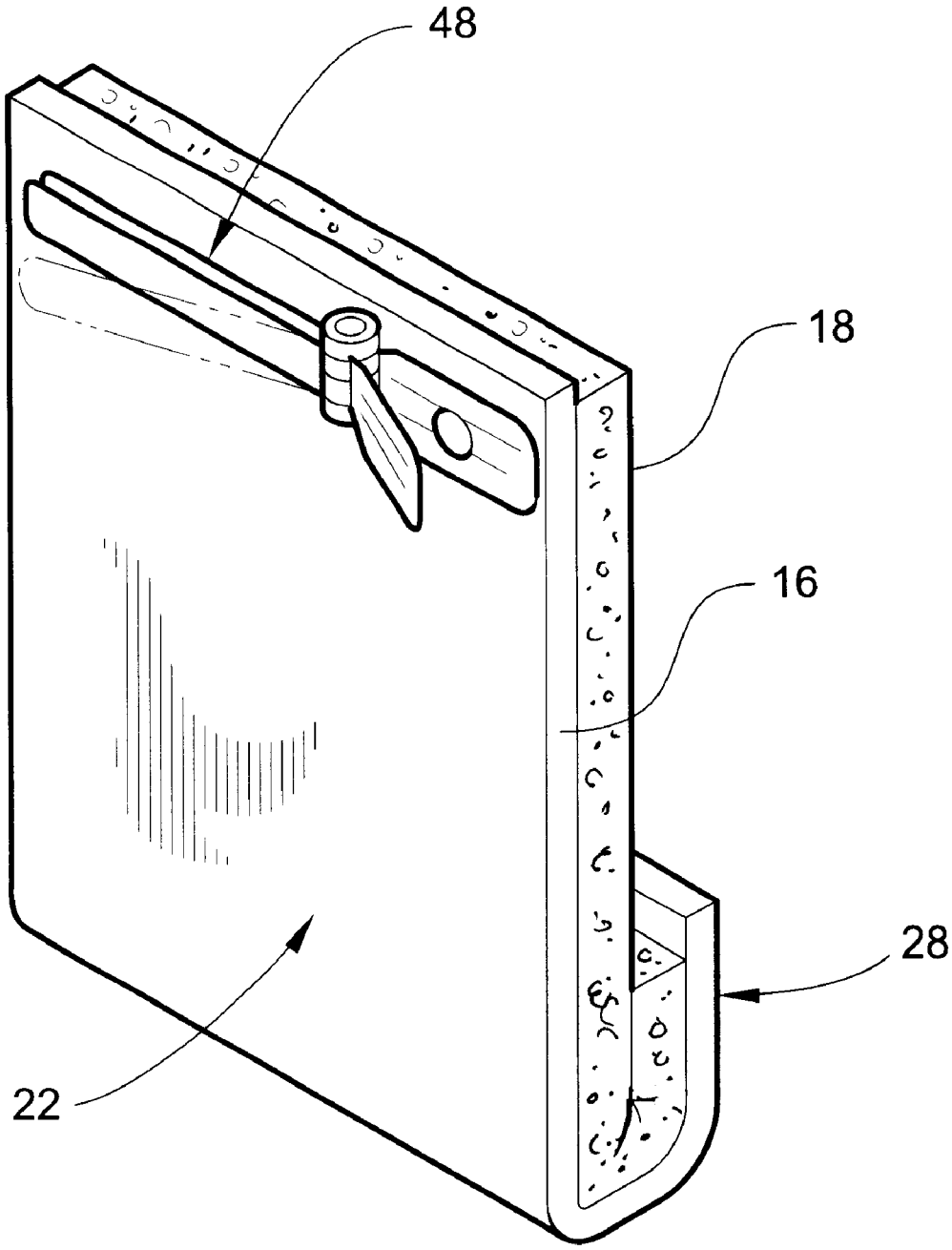
FIG. 16 is a perspective view of the first preferred embodiment of the device including a spring clamp for attaching the device to the golfer.
Figure 17:
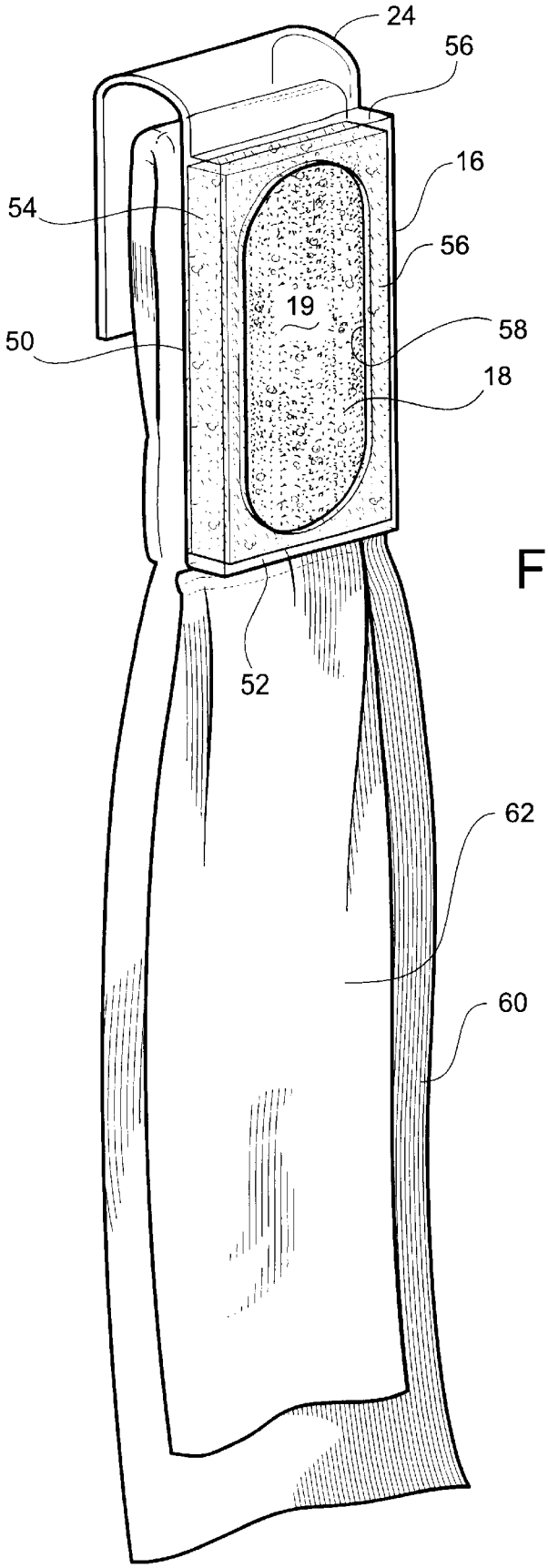
FIG. 17 is a perspective view of a fifth embodiment of the present invention illustrating the use of a plurality of water absorbent cloths attached to the backing of the device.
Figure 18:
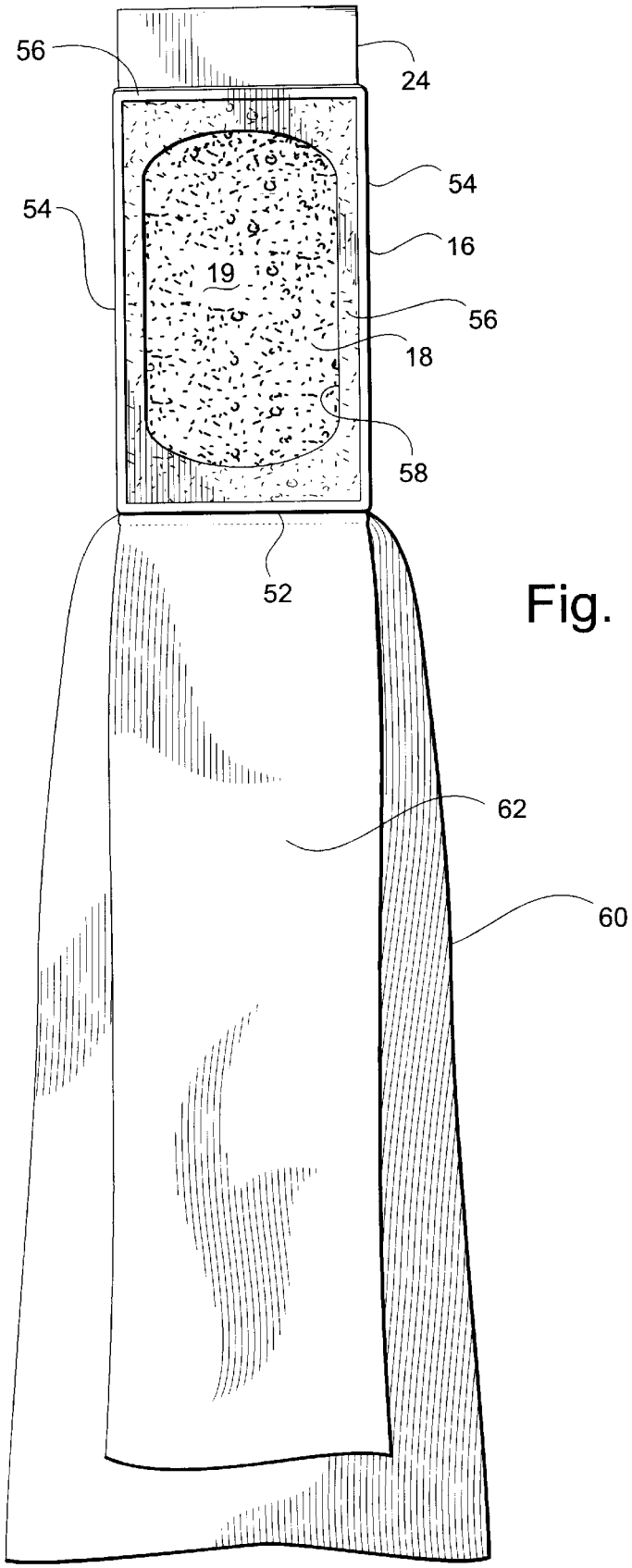
FIG. 18 is a front view of the embodiment of FIG. 17.

FIG. 16 illustrates an alternative embodiment of the attachment means of the preferred embodiments of the present invention. In the alternative embodiment, the. means for removably or releaseably attaching the golf ball cleaning device 10 to a golfer is a clipping device or spring clamp 48, such as, by way of example, a spring-loaded scissor clip, on the back side 22 of the backing 16. As shown in FIG. 16, the spring clamp 48 is moveable between a normally closed position to an open position for clasping the clamp 48 onto a portion of a golfer's clothing or garment and securely attaching the device 10 thereto. While the spring clamp 48 may be used to removably secure the device to the golfer's belt, waistband or on a location on the cart, the spring clamp 48 is preferably inserted and clasped onto a golfer's pocket and used to secure the device 10 on the pocket of a golfer's pants. The spring clamp 48 may be used with any of the preferred embodiments of the present invention and is particularly suitable for use with the golf ball cleaning device of the fourth preferred embodiment which includes the absorbent cloth and is preferably attached to a golfer's pocket.

Figure 19:
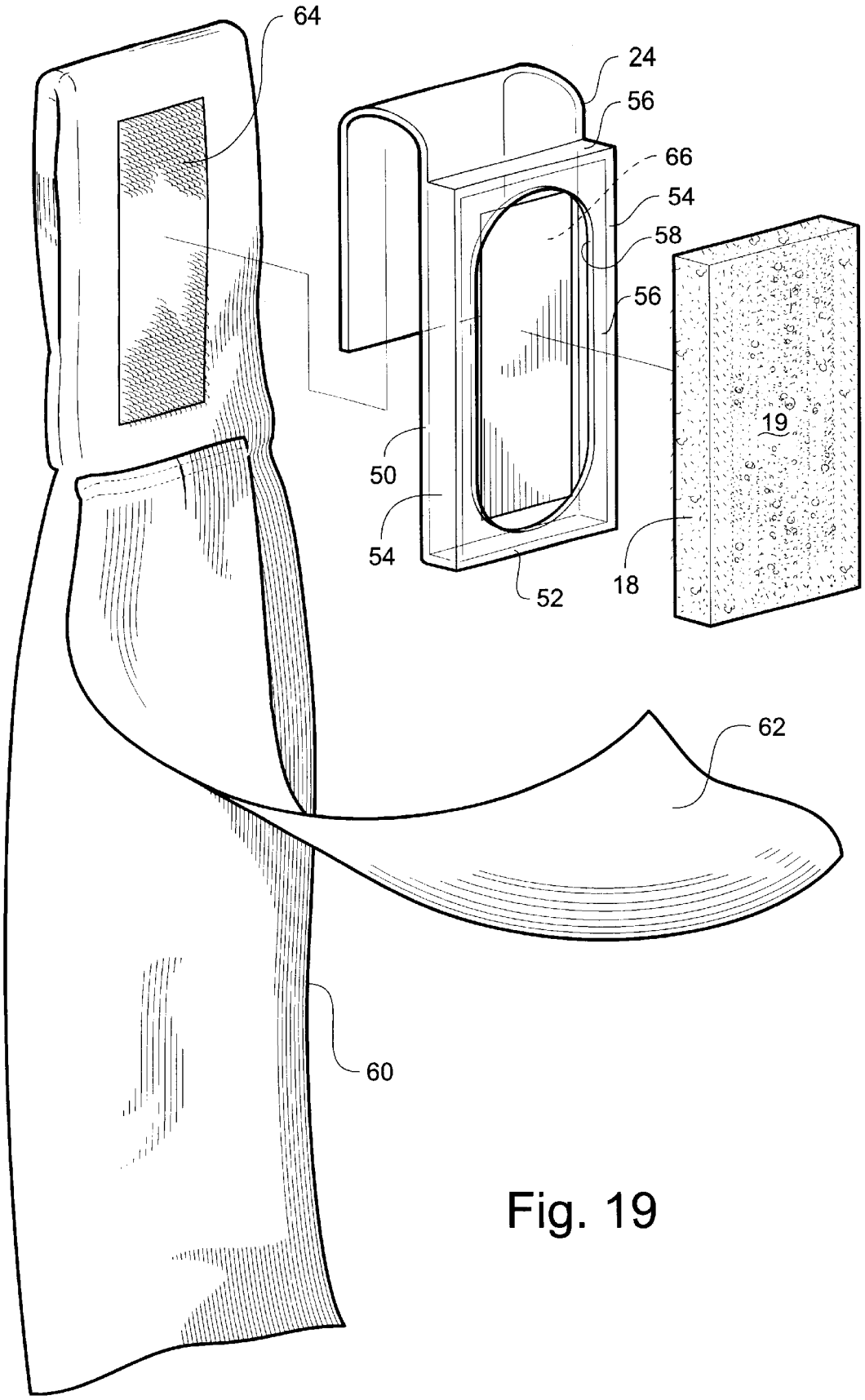
FIG. 19 is a view similar to FIG. 17 showing the components of the device separated.
Figure 20:
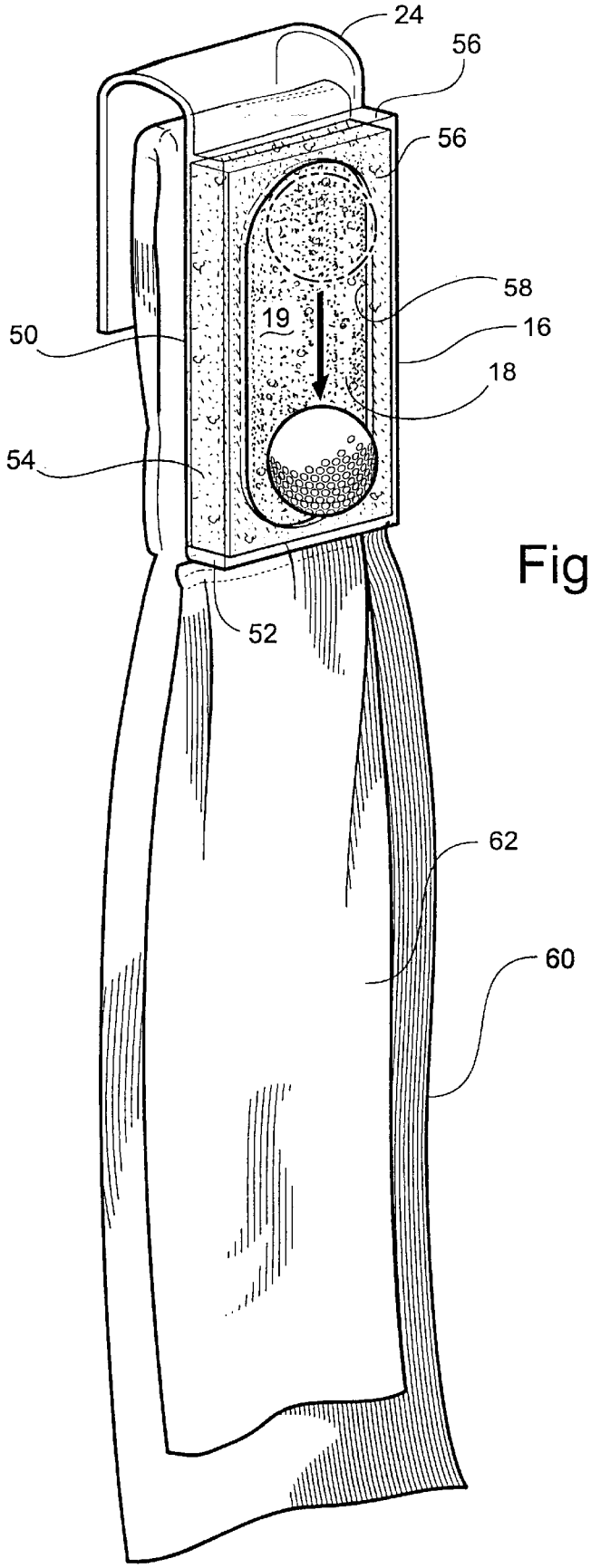
FIG. 20 is a view similar to FIG. 17 showing a golf ball being swiped on the exposed surface of the water absorbent material of the device.

A fifth embodiment of the present invention is illustrated in FIGS. 17–21. This embodiment is similar to the preceding embodiments in that it includes a backing 16 in which a water absorbent material, such as a sponge 18, is mounted with an exposed surface 19 outwardly of the backing. In this embodiment, the backing has a back wall 50, a bottom wall 52, side walls 54, a top wall 55 and a front wall 56. The front wall 56 has a large central opening 58 over the major area of the front of the backing 16 for exposure of the surface 19 of the sponge material 18, with the front wall 56 releasably retaining the sponge material 18 in the backing, but with the opening being large enough and the width of the front wall 56 being sufficiently limited to allow the sponge material 18 to be removed through the opening 48 for wetting or cleaning. As seen in the drawings, the extent of the exposed surface 19 of the sponge 18 is sufficient in a vertical direction for swiping of a golf ball thereon (FIG. 20).

In this embodiment, there are a plurality of water absorbent cloths, which may be two in number, such as the two, 60 and 62, illustrated. These cloths are in the form of towels, one of which is a back cloth 60 and another is a front cloth 62. The front cloth 62 is smaller than the back cloth 60 and is secured, by sewing, to the back cloth along a horizontal line at the top of the front cloth 62 adjacent the backing 16.

The back cloth extends upwardly behind the back wall 50 of the backing 16 and is doubled therealong for extending over a belt or the top of pants worn by a golfer, with the hook portion 24 of the backing 16 extending over the doubled back cloth 16.

The front cloth is intended to be dampened and used for wiping a golf ball or wiping the grip of a golf club or the head of a golf club. The back cloth 60 is for drying a golf ball that has been swiped on the sponge material or any object that has been wiped with the front cloth 62. The front cloth 62 is smaller than the back cloth 60 so that moisture on the front cloth 62 will not contact the garment of the wearer.

In FIG. 19, the components of the fifth embodiment of the present invention are shown separated. Further, this FIG. 19 illustrates the Velcro® attachment of the cloths 60 and 62 to the back wall 50 of the backing 16. For this purpose, one of the Velcro® components is secured to the outwardly facing surface of the back cloth 60 in a location that, when assembled, is behind the bottom wall 52 of the backing 16. Facing rearwardly, on the back wall 50 of the backing 16 is a complimentary Velcro® strip 66.

In assembling the components of the embodiment of FIGS. 17–21, a wetted sponge material 18 is inserted in the backing 16. The back cloth 60 with the front cloth 62 attached is positioned for engagement of the Velcro® components 64 and 66 with the hook 24 of the backing 16 extending over the doubled back cloth 60.

Figure 21:
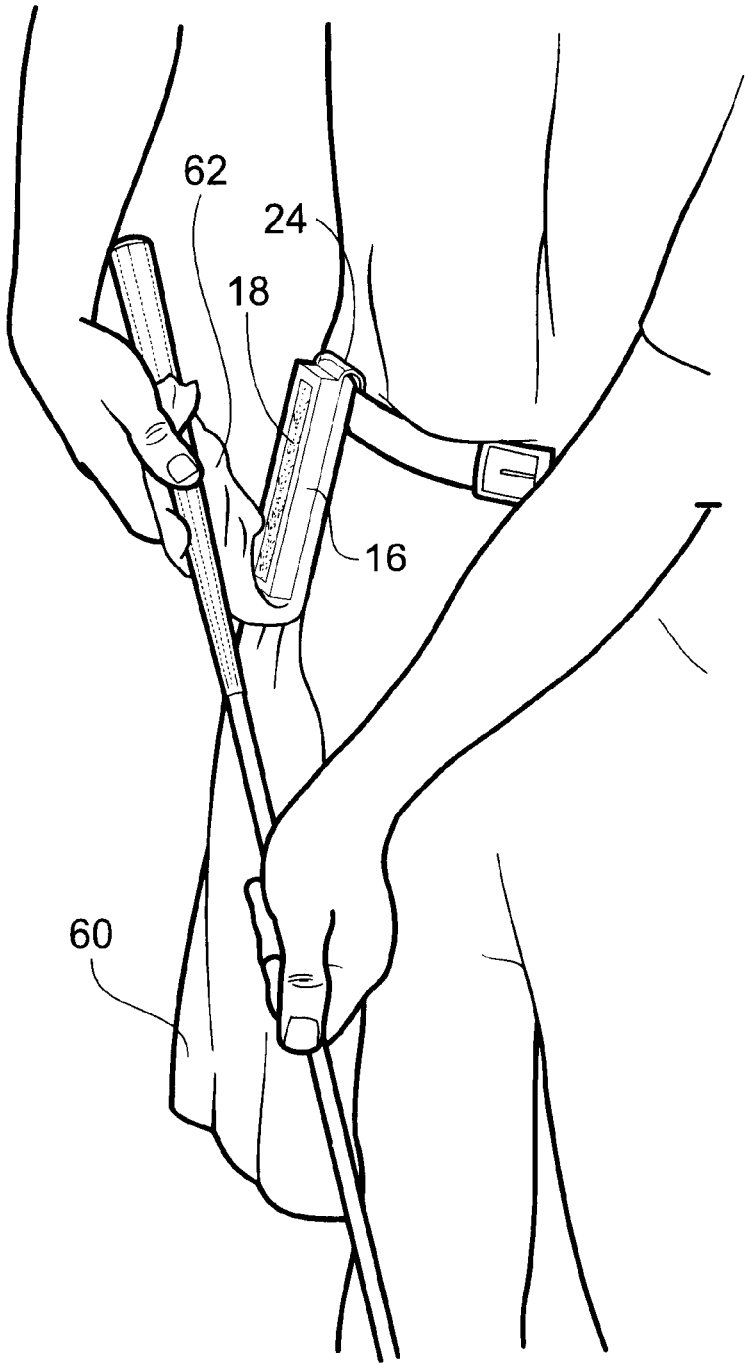
FIG. 21 is a perspective view of the embodiment illustrated in FIG. 17 being used by a golfer to wipe the grip of a golf club.

FIG. 21 illustrates the front cloth 62 being used to wipe the grip of a golf club, which will them be dried on the front cloth 62.

Figure 22:
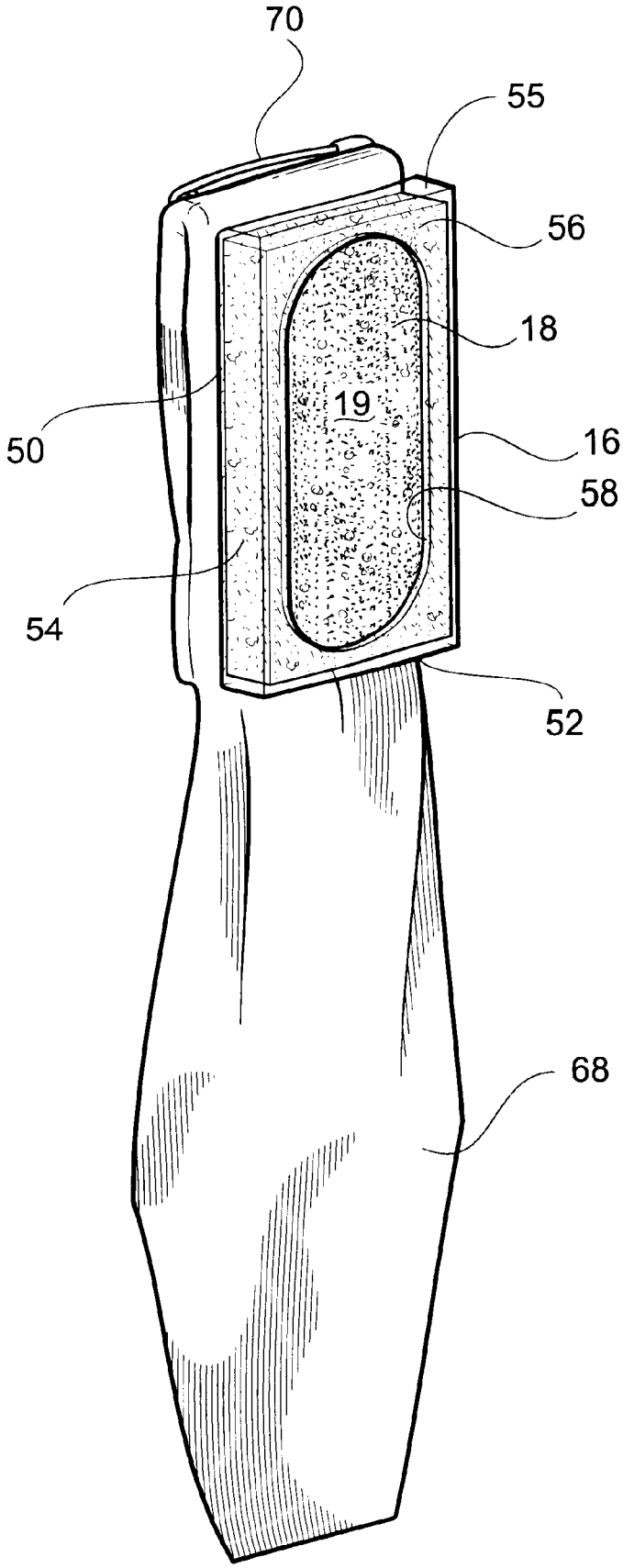
FIG. 22 is a perspective view of a sixth embodiment of the present invention illustrating the backing releasably attached to the cloth and the cloth releasably attachable to the garment of a golfer.
Figure 23:
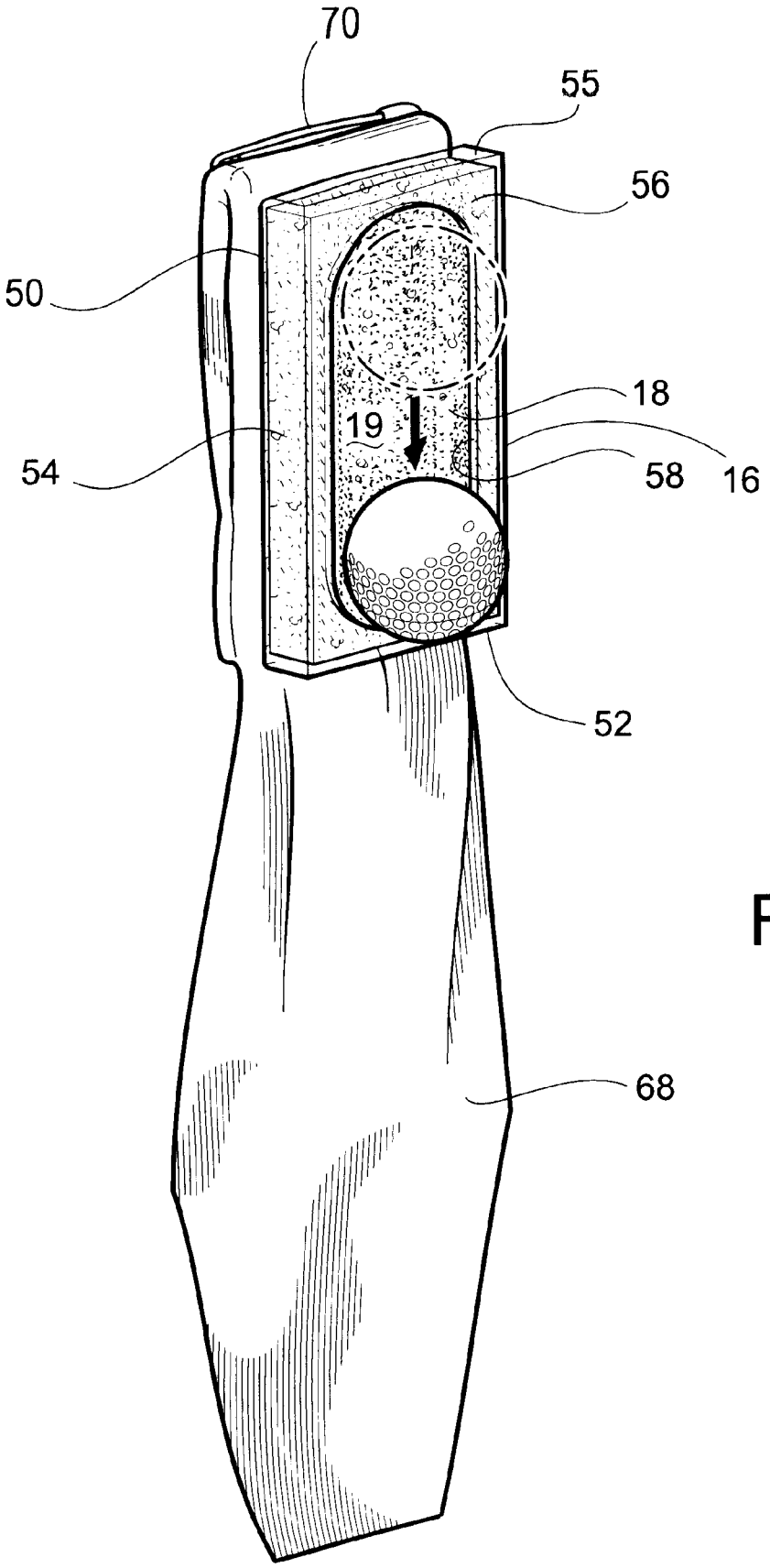
FIG. 23 is a view similar to FIG. 22 illustrating a golf ball being swiped on the device.

A sixth embodiment of the present invention involves a modified form of attaching the components of the device together and for attaching to the garment of a wearer. This is illustrated in FIGS. 22 and 23 in which the backing 16 is releasably attached to a cloth 68 in the same manner as in the embodiment of FIGS. 17–21, i.e., by complimentary Velcro® components attached to the top of the cloth 68 and to the back wall of the backing 16. The cloth 68 is removably attached to the garment of a wearer by a safety pin 70 secured at the top of the cloth 68 and openable and closeable for attachment to the garment, such as the pants, of a golfer. This type of attachment of the components together and to the garment of a wearer can be incorporated as well in any of the other embodiments illustrated and describe herein.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing and extending into said bottom portion, said material having a surface exposed outwardly of said backing and extending in one direction at least one and a half times the diameter of a regulation golf ball for cleaning a golf ball by wiping the golf ball thereon;

c. means for removably attaching said backing to a golfer at a location which is readily accessible and convenient for wiping a golf ball on said water absorbent material;

d. wherein said water absorbent material may be wetted with said bottom portion retaining water therein for preventing water from dripping onto a golfer and keeping said water absorbent material damp; and e. further including a water absorbent cloth attached to said backing and extending below said bottom portion for wiping or drying a golf ball thereon.

2. The portable device of claim 1, wherein the means for removably attaching said backing to the garment of a golfer comprises a hook portion extending outwardly and downwardly from said top end of said back side.

3. The portable device,of claim 1, wherein said bottom portion defines a storage space for storing water.

4. The portable device of claim 3, wherein said storage space further includes a pair of side walls on opposite ends of said bottom portion for holding water within said storage space.

5. The portable device of claim 4, wherein said side walls extend upward from said opposite ends of said bottom portion to said top end of the backing for preventing water from dripping onto a golfer.

6. The portable device of claim 5, wherein said backing includes front walls extending inward from said side walls partially over the water absorbent material for retaining said water absorbent material at the front side of the backing.

7. The portable device of claim 5, wherein said side and front walls form an enclosure for removably retaining said water absorbent material at the front side of the backing.

8. The portable device of claim 1, wherein said water absorbent cloth extends from said top end of said back side to said bottom end and extending below said bottom portion to provide a barrier to prevent water leaking from the device onto the garment of a wearer.

9. The portable device of claim 1, wherein the means for removably attaching said backing to a golfer comprises a hook portion extending outwardly and downwardly from said top end of said back side, said hook portion being adapted to be inserted in a pocket of a golfer's garment with the exposed water absorbent material being exterior of the garment.

10. The portable device of claim 1, wherein the water absorbent material is water absorbent sponge material.

11. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing and extending into said bottom portion, said material having a surface exposed outwardly of said backing and extending in one direction by at least a diameter of the golf ball for swiping a golf ball thereon to clean the same;

c. means for removably attaching said backing to the exterior of a golfer's garment at a location which is readily accessible and convenient for swiping a golf ball on said water absorbent material;

d. a water absorbent cloth attached to said backing and extending below said bottom portion for wiping or drying a golf ball thereon;

e. wherein said water absorbent material may be wetted with said bottom portion retaining water therein for preventing water from dripping onto a golfer and keeping said water absorbent material damp.

12. The portable device of claim 11, wherein the means for removably attaching said backing to the garment of a golfer comprises a hook portion extending outwardly and downwardly from said top end of said back side.

13. The portable device of claim 12, wherein said hook portion extends across the width of said back side of said backing.

14. The portable device of claim 11, wherein said means for removably attaching said backing to the garment of a golfer comprises a hook and loop type fastening means having a first portion adhered to the garment of the golfer and a second complementary portion adhered to said back side and retainingly engageable with said first portion.

15. The portable device of claim 11, wherein said means for removably attaching said backing to a golfer comprises a spring clamp attached to said backing for releasably clasping onto the garment of the golfer.

16. The portable device of claim 11, wherein said bottom portion defines a storage space for storing water.

17. The portable device of claim 16, wherein said water absorbent material is doubled on itself in said bottom portion.

18. The portable device of claim 16, wherein said storage space further includes a pair of side walls on opposite ends of said bottom portion for holding water within said storage space.

19. The portable device of claim 18, wherein said side walls extend upward from said opposite ends of said bottom portion to said top end of the backing for preventing water from dripping onto a golfer.

20. The portable device of claim 19, wherein said backing includes front walls extending inward from said side walls partially over the water absorbent material for retaining said water absorbent material at the front side of the backing.

21. The portable device of claim 19, wherein said side and front walls form an enclosure for removably retaining said water absorbent material at the front side of the backing.

22. The portable device of claim 11, wherein said water absorbent material is adhered to said front side of said backing.

23. The portable device of claim 11, wherein said backing is a lightweight plastic.

24. The portable device of claim 11, wherein said water absorbent cloth extends from said top end of said back side to said bottom end and extending below said bottom portion to provide a barrier to prevent water escaping from the device onto the garment of a wearer.

25. The portable device of claim 11, wherein the means for removably attaching said backing to a golfer comprises a hook portion extending outwardly and downwardly from said top end of said back side, said hook portion being adapted to be inserted,in a pocket of a golfer's garment with the exposed water absorbent material being exterior of the garment.

26. The portable device of claim 11, wherein the means for removably attaching said backing to a golfer comprises a spring clamp attached to said back side of said backing for releasably clasping onto the garment of a wearer.

27. The portable device of claim 11 wherein the water absorbent material is water absorbent sponge material.

28. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing, exposed outwardly therefrom, and extending into said bottom portion;

c. means for removably attaching said backing to the exterior of a golfer's garment at a location which is readily accessible and convenient for wiping a golf ball on said water absorbent material, d. wherein said water absorbent material may be wetted with said bottom portion retaining water therein for preventing water from dripping onto a golfer and keeping said water absorbent material damp; and e. a plurality of water absorbent cloths attached to said backing and extending below said bottom portion, said plurality of cloths including a back cloth for drying a golf ball or golf club and a front cloth for damp wiping of a golf ball or golf club.

29. The portable device of claim 28 wherein said front cloth is smaller than said back cloth.

30. The portable device of claim 28 wherein said plurality of cloths are removably attached to said backing.

31. The portable device of claim 30 wherein said first cloth is attached to said back cloth and said back cloth is attached to said back side of said backing.

32. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing, exposed outwardly therefrom, and extending into said bottom portion for wiping a golf ball on said sponge material;

c. wherein said water absorbent material may be wetted with said bottom portion retaining water therein for preventing water from dripping onto a golfer and keeping said water absorbent material damp;

d. a plurality of water absorbent cloths attached to said backing and extending below said bottom portion, said plurality of cloths including a back cloth for drying a golf ball or golf club and a front cloth for damp wiping of a golf ball or golf club;

e. means for attaching said backing to said plurality of cloths; and f. means for removably attaching said plurality of cloths to the exterior of a golfer's garment at a location which is readily accessible and convenient.

33. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing, exposed outwardly therefrom, and extending into said bottom portion for wiping a golf ball on said water absorbent material;

c. wherein said water absorbent material may be wetted with said bottom portion retaining water therein for preventing water from dripping onto a golfer and keeping said water absorbent material damp;

d. a water absorbent cloth attached to said backing and extending below said bottom portion for drying a golf ball or golf club;

e. means for attaching said backing to said cloth; and f. means for removably attaching said cloth to the exterior of a golfer's garment at a location which is readily accessible and convenient.

* * * * *